US007537459B2

(12) United States Patent
Takegahara et al.

(10) Patent No.: US 7,537,459 B2
(45) Date of Patent: May 26, 2009

(54) ANISOTROPIC CONDUCTIVE FILM

(75) Inventors: Ikuo Takegahara, Kyoto (JP); Shinichiro Kawamura, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/596,329

(22) PCT Filed: May 10, 2005

(86) PCT No.: PCT/JP2005/008509

§ 371 (c)(1),
(2), (4) Date: Sep. 17, 2007

(87) PCT Pub. No.: WO2005/109576

PCT Pub. Date: Nov. 17, 2005

(65) Prior Publication Data

US 2008/0014796 A1 Jan. 17, 2008

(30) Foreign Application Priority Data

May 11, 2004 (JP) ..... 2004-141278

(51) Int. Cl.
*H01R 12/00* (2006.01)

(52) U.S. Cl. ..... 439/66

(58) Field of Classification Search ..... 439/591, 439/66, 67, 91; 228/180.22, 235.1
See application file for complete search history.

(56) References Cited

U.S. PATENT DOCUMENTS 6,015,081 A * 1/2000 Okabayashi et al. ... 228/180.22
6,019,610 A * 2/2000 Glatts, III ..... 439/66
6,217,343 B1 4/2001 Okuno

FOREIGN PATENT DOCUMENTS

| | | |
|---|---|---|
| JP | 11-121659 | 4/1999 |
| JP | 2000-131342 | 5/2000 |
| JP | 2000-183121 | 6/2000 |
| JP | 2001-228975 | 8/2001 |
| JP | 2001-332323 | 11/2001 |
| JP | 3352705 B2 | 9/2002 |
| JP | 3360772 B2 | 10/2002 |
| WO | 97/44859 A1 | 11/1997 |

OTHER PUBLICATIONS

Chinese Office Action issued in Chinese Application No. 2005800153862 mailed on Jan. 4, 2008 and English translation thereof, 16 pages.

* cited by examiner

*Primary Examiner*—Jean F Duverne
(74) *Attorney, Agent, or Firm*—Osha • Liang LLP

(57) ABSTRACT

The objective of the present invention is to provide an anisotropic conductive film that is easily manufactured with high productivity and high yield. For this purpose, a pair of slits 13 are formed on a sheet-shaped base material 12 made of a flexible insulating film, and this is cut out to prepare a support member 14, and contact portions 16 and 17 are formed on the upper and lower surfaces thereof. Moreover, a conductive film 15, which makes only a pair of the contact portions 16 and 17, placed on the upper and lower surfaces, mutually conductive independently, is formed so that a conductive unit 11 is formed; thus, a number of the conductive units 11 are formed and aligned side by side.

20 Claims, 13 Drawing Sheets

ANISOTROPIC CONDUCTIVE FILM

FIELD OF THE INVENTION

The present invention relates to an anisotropic conductive film, and more specifically, concerns an anisotropic conductive film in which a number of conductive units that provide conduction only in a thickness direction are installed.

BACKGROUND OF THE INVENTION

Conventionally, with respect to the anisotropic conductive film, for example, a structure has been proposed in which fine metal particles are embedded in an insulating film, with the upper and lower end portions of the metal particles being allowed to respectively protrude from the surface and rear surface of the insulating film, so that conduction is made only in a vertical direction (see Patent Documents 1 and 2).

Patent Document 1: Japanese Patent No. 3360772

Patent Document 2: Japanese Patent No. 3352705

DISCLOSURE OF THE INVENTION

Problems to be Solved by the Invention

In the above-mentioned anisotropic conductive film, however, in an attempt to ensure a uniform connecting property, it is necessary not only to provide high dimensional precision with respect to the fine metal particles, but also to embed the fine metal particles in an insulating film with high positioning precision. For this reason, the above-mentioned anisotropic conductive film is not easily manufactured, with the result that the productivity is low with a poor yield.

The present invention has been devised so as to solve the above-mentioned problems, and its objective is to provide an anisotropic conductive film that is easily manufactured with high productivity and a high yield.

Means to Solve the Problems

In order to solve the above-mentioned problems, the anisotropic conductive film of the present invention has a structure in which: at least one slit is formed on a sheet-shaped base material made of a flexible insulating film, and this is cut out to prepare a support member, and contact portions are formed on the upper and lower surfaces thereof, with a conductive film, which makes only a pair of the contact portions, placed on the upper and lower surfaces, mutually conductive independently, being formed so that a conductive unit is prepared; thus, a number of the conductive units are formed and aligned side by side.

EFFECTS OF THE INVENTION

In accordance with the present invention, a number of conductive units, each constituted by a pair of contact portions that provide conduction only in a thickness direction, are formed on a sheet-shaped base material so that even when external contacts positioned on the same plane are respectively made in contact with the contact portions of the conductive units, the electrical connection is easily made without short-circuiting.

Moreover, in accordance with the present invention, since the support member is prepared by cutting out a flexible insulating film with a slit being formed therein, the resulting film is easily elastically deformed so that deviations in the dimensional precision can be easily absorbed and alleviated.

For this reason, since no such high dimensional precision as to be required in the prior art is required, the manufacturing process becomes easier, making it possible to improve the productivity with a high yield.

In one embodiment relating to the present invention, the support member may have a two-ends supported beam shape, a cantilever beam shape, or a shape in which the two ends are supported, with a twisting action being is exerted thereto.

In accordance with this embodiment, since the shape of the support member is changed on demand, the degree of freedom in selection is expanded so that the designing process is easily carried out.

In another embodiment relating to the present invention, the contact portions may be prepared as metal contacts formed on the surface of a conductive film, or as conductors made from materials such as an organic conductive substance, carbon and a conductive bonding-agent cured material, or may be formed by placing a conductive film on the surface of protruding portions that respectively protrude from the surface and rear surface of the support member.

In accordance with this embodiment, since the shape of the contact portions is changed on demand, the degree of freedom in selection is expanded so that the designing process is easily carried out. In particular, the latter contact portions can be efficiently formed so that the productivity becomes higher.

In still another embodiment of the present invention relating to the present invention, a lead wire that is conductive to the respective contact portions may be formed on one surface of the sheet-shaped base material by using a printing process, an etching process or the like.

In accordance with this embodiment, the resulting film can be used as a flexible connector for a printed substrate.

In still another new embodiment relating to the present invention, a common conductive film, which makes all the contact portions located on the surface of the sheet-shaped base material conductive is formed on the surface, and leg portions, which are higher than the contact portions located on the rear surface of the sheet-shaped base material, may be formed on the rear surface in a protruding manner.

In accordance with this embodiment, in an arrangement in which lower electrodes, which correspond to the contact portions on the rear surface side, are formed on the lower side, by depressing the sheet-shaped base material to allow the support member to be elastically deformed, the contact portions on the rear face side are made in contact with the lower electrodes so that the electrical connection is made through the common conductive film; thus, this structure may be applied to constituent members for a thin-type switch, a pressure-sensitive sensor, a fingerprint sensor or a touch sensor.

In still another different embodiment relating to the present invention, the contact portions may be placed side by side in a linear shape or in an annular shape.

In accordance with this embodiment, in an arrangement in which a row of terminals corresponding to the contact portions are formed on the lower side, by depressing the sheet base material to allow the support member to be elastically deformed, the contact portions are made in contact with the row of terminals so that the electrical connection is made through the common conductive film; thus, this structure may be applied to constituent members for an encoder.

In the other embodiment relating to the present invention, a bonding agent may be sealed in the slit, with a microcapsule, which can be ruptured, being also injected therein, or a bonding agent may be sealed in the peripheral edge portion of the slit, with a microcapsule, which can be ruptured, being also placed therein, or an adhesive, which is allowed to exert a bonding function when heated, may be placed in the peripheral edge portion of the slit.

In accordance with this embodiment, the anisotropic conductive film can be bonded to another member as an integral part through the bonding agent and the adhesive, and also electrically connected thereto; thus, the resulting effects are that the connecting operation becomes easier and that the assembling operability is improved.

REFERENCE NUMERALS

Figure 1:
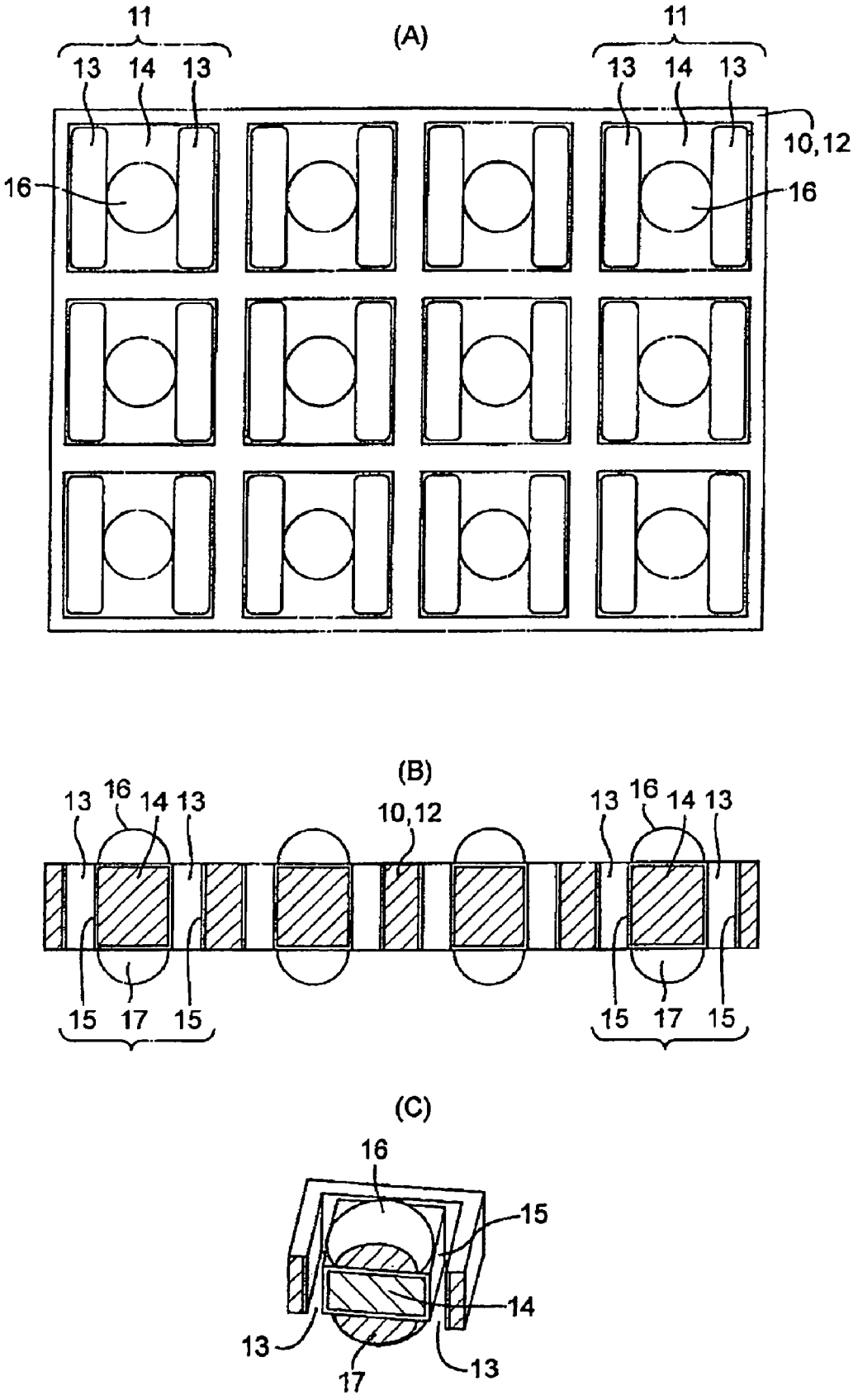
FIGS. 1A, 1B and 1C are a plan view, a cross-sectional view and a partial cross-sectional perspective view that show a first embodiment in accordance with the present invention.
Figure 2:
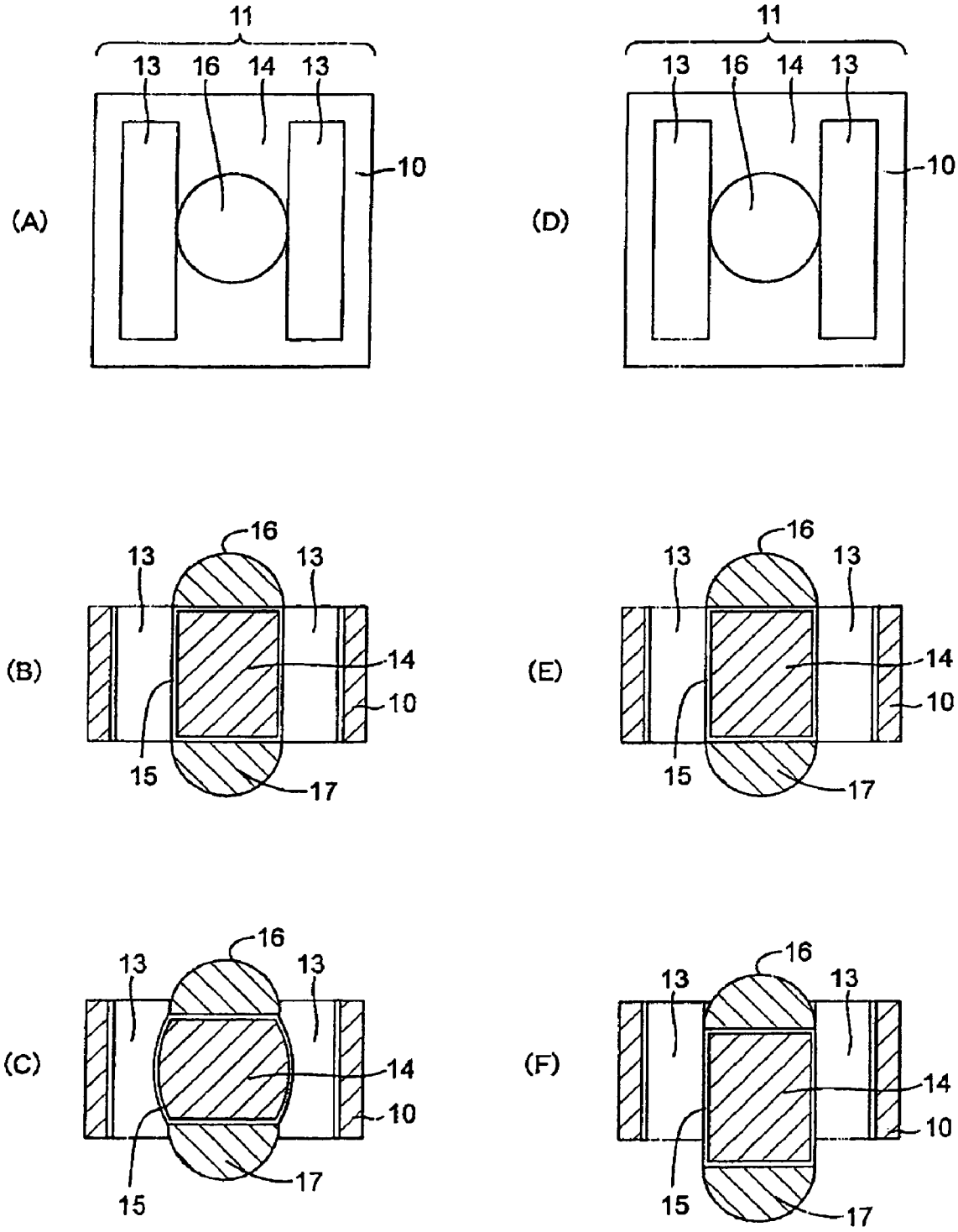
FIGS. 2A, 2B and 2C are a partial plan view, a partial cross-sectional view and a partial cross-sectional view that shows a state after a modification, in accordance with the first embodiment.
FIGS. 2D, 2E and 2F are a partial plan view, a partial cross-sectional view and a partial cross-sectional view that shows a state after a modification in accordance with an applied example thereof.

10: Anisotropic conductive film
11: Conductive unit
12: Insulating film
13: Slit
14: Support member
15: Conductive film
15*a*: Lead wire
16, 17: Contact portion
18: Common conductive film
19: Leg portion
20: Microcapsule
21: Bonding agent
22: Adhesive
30, 32: Print substrate
31, 33: Connection pad
34, 36: Fixed plate
35: Lower electrode
37: Print substrate
38: Connection pad
38*a*: Lead wire
40: Protective film
41: Lower electrode
42, 43: Fixed electrode
44, 45: Fixed electrode

BEST MODE FOR CARRYING OUT THE INVENTION

Referring to attached drawings, FIGS. 1 to 13, the following description will discuss embodiments in accordance with the present invention.

As shown FIGS. 1 to 5, the first embodiment relates to an anisotropic conductive film 10 in which conductive units 11 are arranged in a lattice pattern. With respect to each of the conductive units 11, a support member 14, which is supported at two ends thereof on a sheet-shaped base material 12 made of a flexible resin film, with a pair of slits 13 being formed therein, is cut out. Moreover, a conductive film 15, which allows only the opposing upper and lower faces of the support member 14 to conduct to each other independently, is installed. Furthermore, contact portions 16 and 17 are respectively formed on the upper and lower faces of the support member 14 so that a number of conductive units 11 are formed in a lattice pattern. The present embodiment may be applied in a mode in which, as shown in FIGS. 2A to 2C, the support member 14 is compressed and elastically deformed, or in a mode in which, as shown in FIGS. 2D to 2F, the center portion of the support member 14 is deflected. The size of the conductive unit 11 may be altered on demand, and, for example, one having an external dimension in a range from 5 to 1000 μm may be used.

With respect to the sheet-shaped base material 12, for example, polyethylene resin, polypropylene resin, polystyrene resin, ABS resin (acrylonitrile butadiene styrene), PMMA resin (polymethyl acrylate), epoxy resin, unsaturated polyester resin and phenolic resin may be used. Moreover, engineering plastic materials may be used, and specific examples thereof include: PI (polyimide), PAI (polyamide-imide), PET (polyethylene terephthalate), PEN (polyethylene naphthalate), PEEK (polyetherether ketone), LCP (liquid crystal polymer), PBT (polybutylene terephthalate), PC (polycarbonate), PEI (polyether imide), PA (polyamide (nylon)), PAN (polyacrylonitrile), PPS (polyphenylene sulfide) and aramide. The thickness dimension of the sheet-shaped base material 12 is normally set to about 250 μm, and is more preferably set to 100 μm or less in order to provide desirable flexibility to the support member 14.

Figure 3:
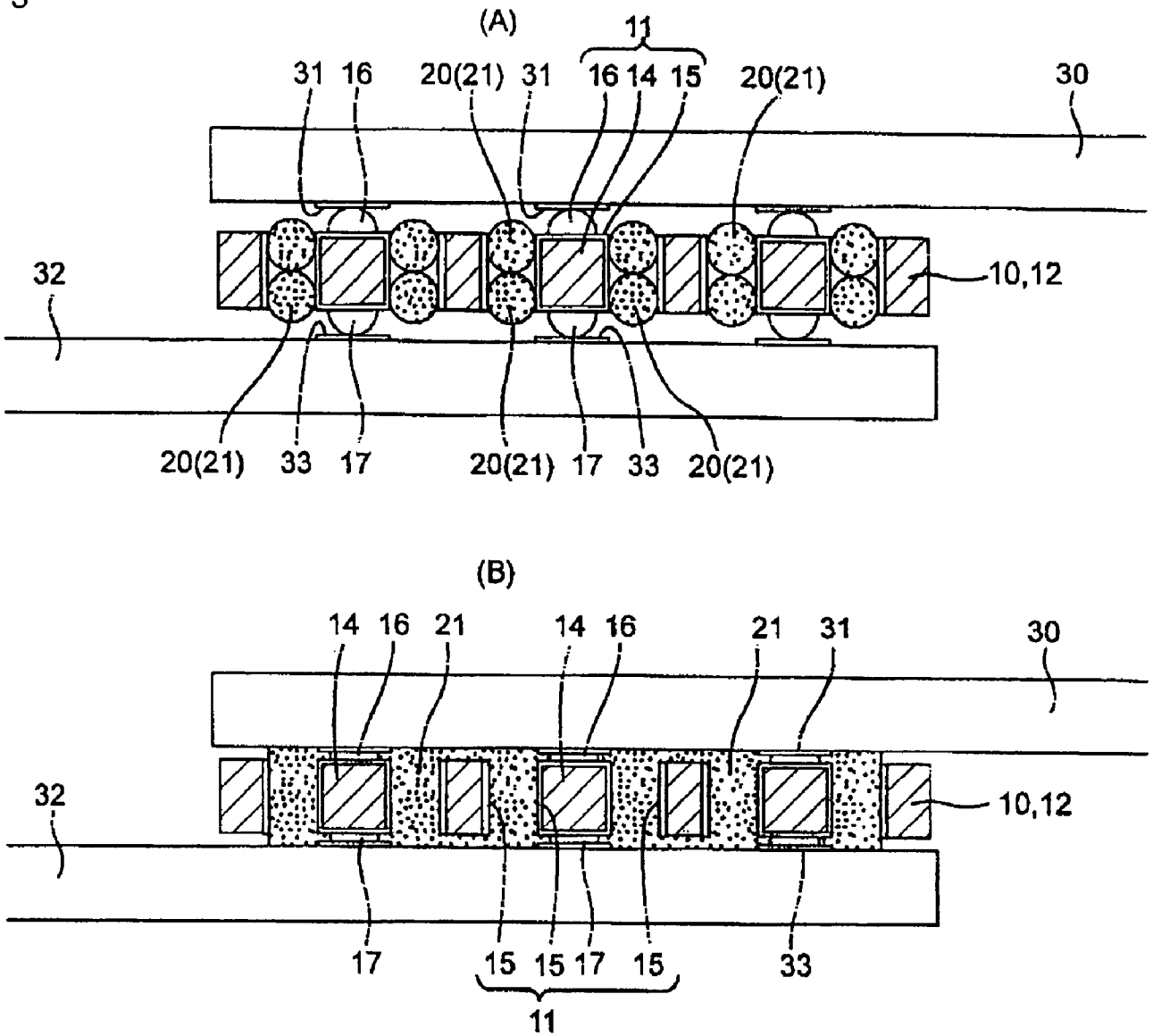
FIGS. 3A and 3B are cross-sectional views that show a state before a connection and a state after the connection in a connection method in accordance with the first embodiment of the present invention.

The anisotropic conductive film 10 in accordance with the present embodiment may be used as, for example, a connector, as shown in FIG. 3.

In other words, a microcapsule 20 in which a bonding agent 21 is sealed is injected into the slit 13 of the anisotropic conductive film 10 in accordance with the present embodiment. Next, to the contact portions 16 and 17 of the conductive unit 11, connection pads 31 and 33 of print substrates 30 and 32 that are print-wired are positions from above as well as from below. These are then pressed or heated so that the above-mentioned microcapsule 20 is ruptured to cause the bonding agent 21 to jump out; thus, the print substrates 30 and 32 are bonded to the anisotropic conductive film 10 into an integral part by the bonding agent 21 so that the print substrates 30 and 32 are electrically connected to each other.

In particular, by making the size of each conductive unit 11 smaller with a narrower pitch so that the number of the conductive units 11 that come into contact with each of the connection pads 31 and 33 is increased, the connection pads 31 and 33 are inevitably made in contact with the conductive unit 11. The resulting advantage is that, by simply positioning the connection pads 31 and 33 with each other, the electrical conduction between these can be made so that it becomes possible to improve the assembling operability.

Figure 4:
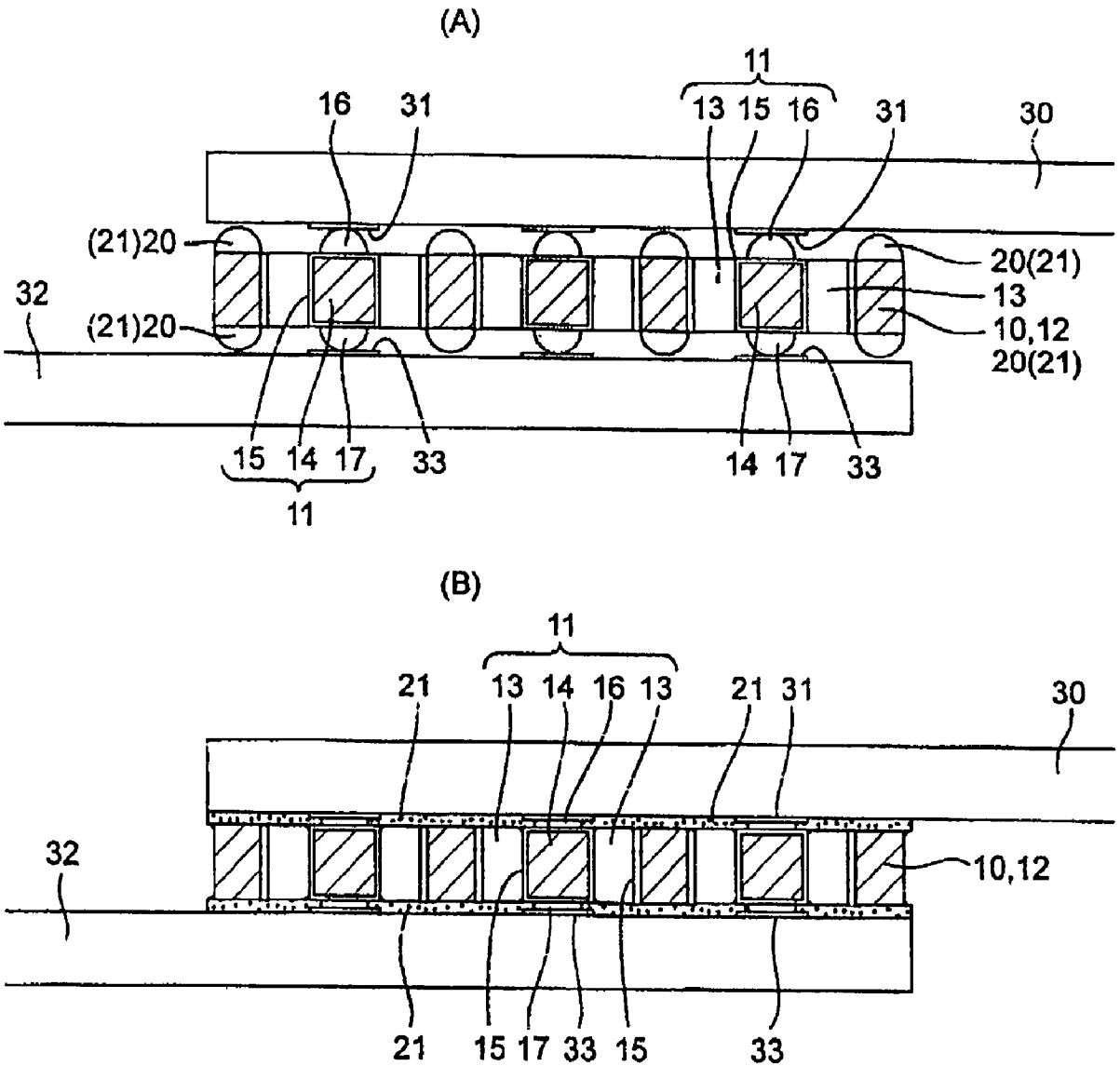
FIGS. 4A and 4B are cross-sectional views that show a state before a connection and a state after the connection in another connection method of the present invention.

Moreover, in another application method, as shown in FIG. 4, a concave section, not shown, is formed between the conductive units 11 of the anisotropic conductive film 10 of the present embodiment. Next, a bonding agent 21 is injected to the concave section and sealed therein, and a rupturable microcapsule 20 is also placed therein. Then, connection pads 31 and 33 of flexible print substrates 30 and 32 that are print-wired are positioned at the connection portions 16 and 17 of the conductive unit 11 from above as well as from below. This is then pressed or heated so that the above-mentioned microcapsule 20 is ruptured to cause the bonding agent 21 to jump out; thus, the print substrates 30 and 32 are bonded to the anisotropic conductive film 10 into an integral part by the bonding agent 21 so that the print substrates 30 and 32 are electrically connected to each other.

Figure 5:
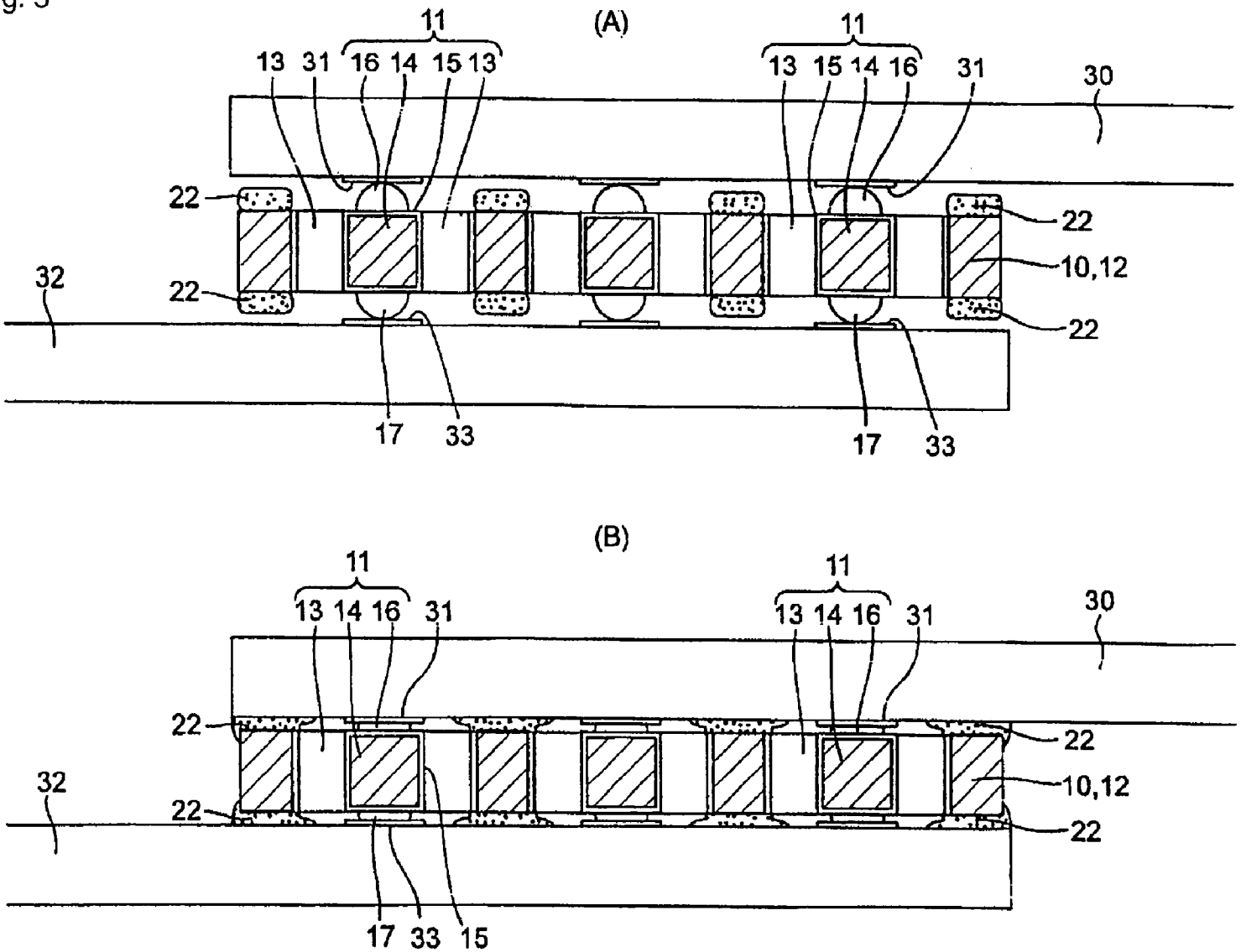
FIGS. 5A and 5B are cross-sectional views that show a state before a connection and a state after the connection in still another connection method of the present invention.

In still another application method, as shown in FIG. 5, an adhesive 22 is placed between the conductive units 11 of the anisotropic conductive film 10 in accordance with the present embodiment. Next, connection pads 31 and 33 of flexible print substrates 30 and 32 that are print-wired are positioned at the connection portions 16 and 17 of the conductive unit 11 from above as well as from below. This is then pressed so that the print substrates 30 and 32 are integrally bonded to the anisotropic conductive film 10 by the adhesive 22 in a manner so as to be separable; thus, the print substrates 30 and 32 are electrically connected to each other.

Here, by using the microcapsule 20 in which a bonding agent 21 is sealed and the adhesive 22 in combination, after the print substrates 30 and 32 have been temporarily secured to each other through the adhesive 22, this is pressed or heated to rupture the microcapsule 20 so that these substrates may be integrally bonded to each other by the bonding agent 22. Moreover, the adhesive 22 may be allowed to function as a bonding agent when it is heated.

Figure 6:
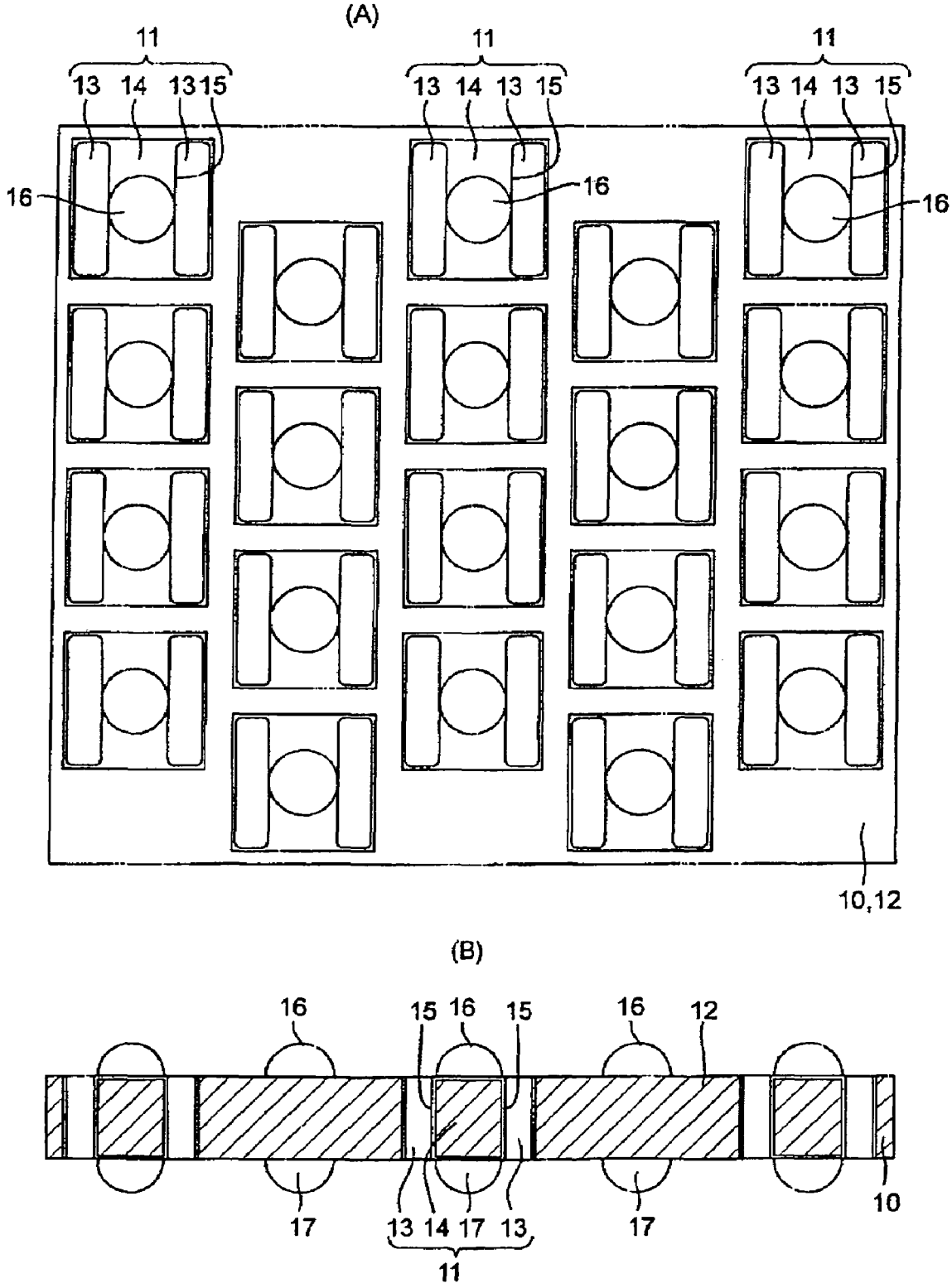
FIGS. 6A and 6B are a plan view and a cross-sectional view that show a second embodiment in accordance with the present invention.
Figure 7:
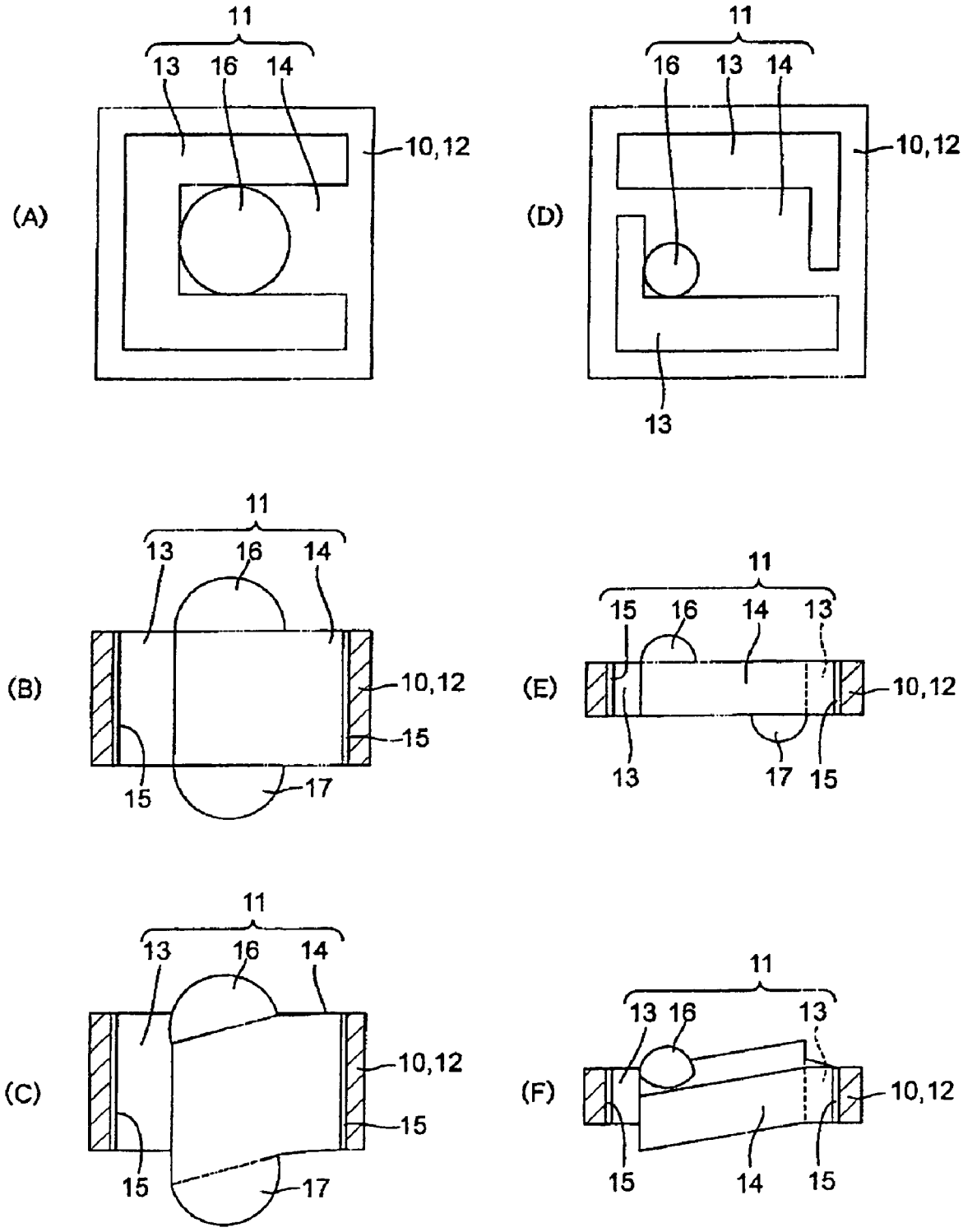
FIGS. 7A, 7B and 7C are a partial plan view, a partial cross-sectional view and a partial cross-sectional view that shows a state after a modification, in accordance with the third embodiment.
FIGS. 7D, 7E and 7F are a partial plan view, a partial cross-sectional view and a partial cross-sectional view that shows a state after a modification in accordance with a fourth embodiment.

In contrast to the first embodiment in which the conductive units 11 are placed in a lattice pattern, as shown in FIG. 6, the second embodiment has a structure in which conductive units 11 are placed in a staggered pattern. In accordance with the present embodiment, since the conductive units 11 have the staggered pattern, the resulting advantage is that a better contacting property to external contacts is obtained.

Here, in addition to the above-mentioned two-ends supported structure, the support member 14 of the conductive unit 11 may have, for example, a cantilever beam shape, which is shown as a third embodiment (see FIGS. 7A to 7C), or a shape in which the two ends are supported with a twisting moment is exerted thereto, which is shown as a fourth embodiment (see FIGS. 7D to 7F).

Figure 8:
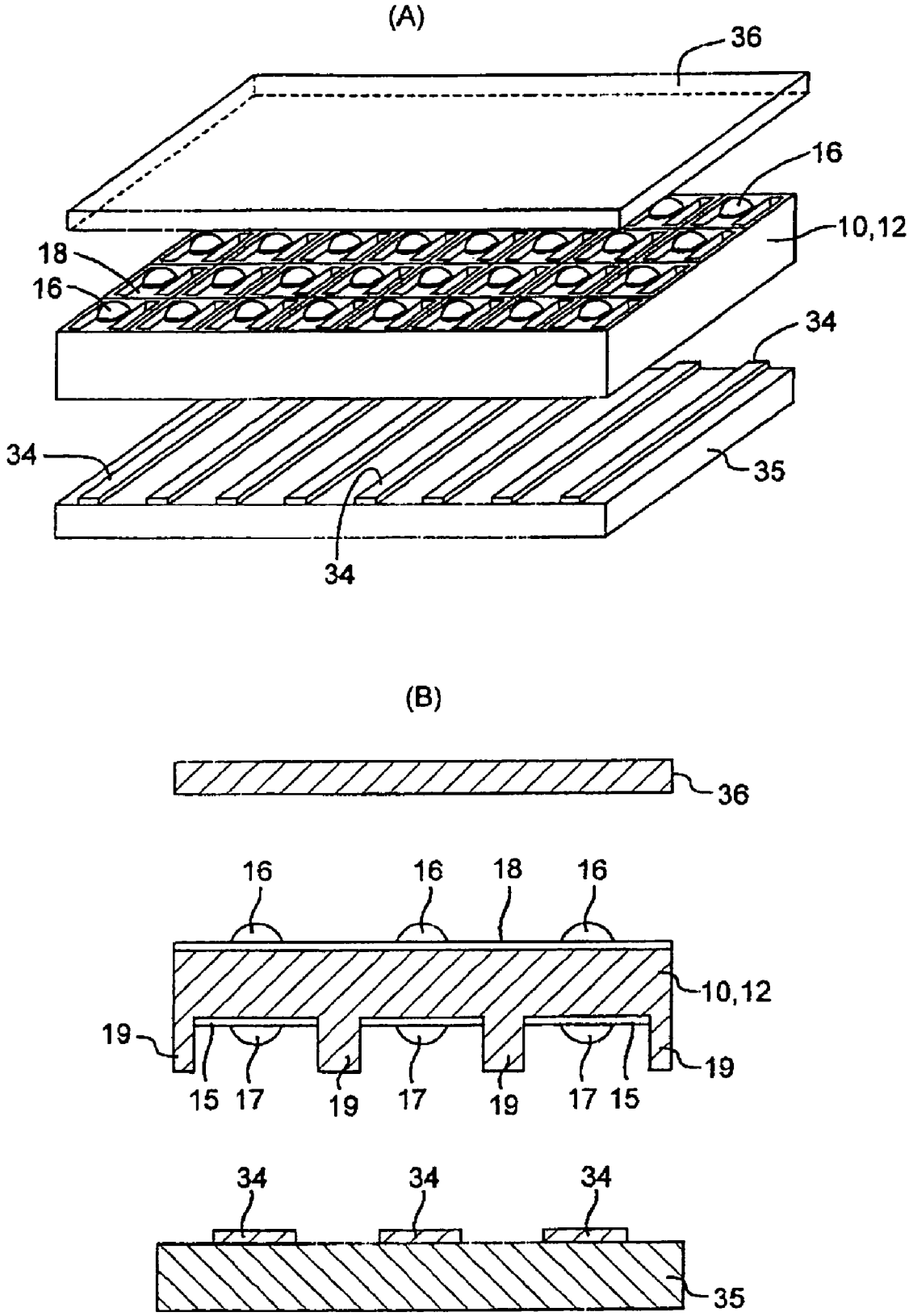
FIGS. 8A and 8B are an exploded perspective view and an exploded front view that show a fifth embodiment.
Figure 9:
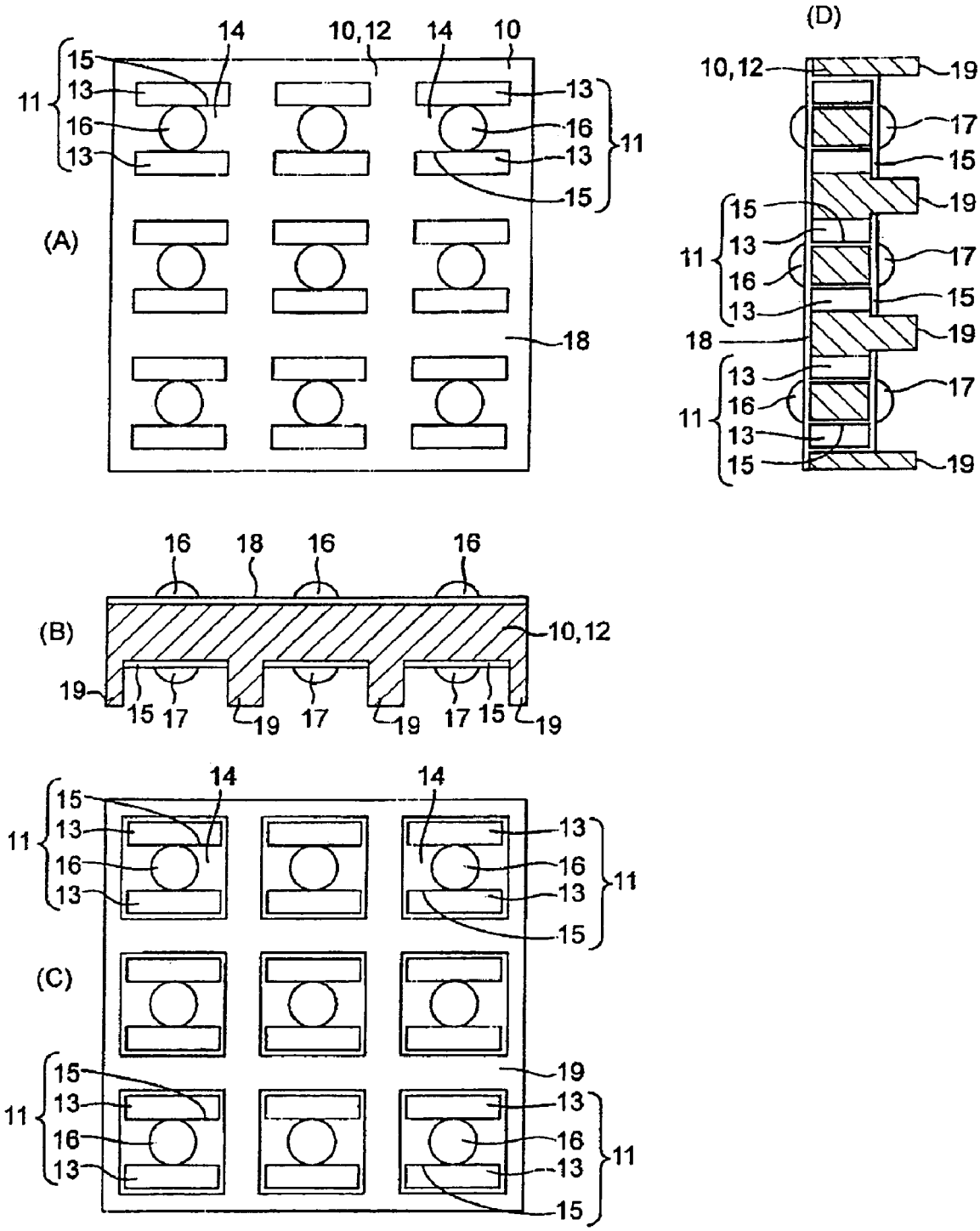
FIGS. 9A, 9B, 9C and 9D are a plan view, a front cross-sectional view, a bottom view and a cross-sectional view on the right side, which show an anisotropic conductive film of the fifth embodiment in accordance with the present invention.

In a fifth embodiment, as shown in FIGS. 8 and 9, the anisotropic conductive film 10 of the present embodiment is applied to a pressure-sensitive position sensor.

The pressure-sensitive position sensor of the present embodiment is constituted by a lower electrode plate 35 in which a plurality of fixed electrodes 34 are placed side by side in parallel with each other, an anisotropic conductive film 10 and a protective film 36. The anisotropic conductive film 10 has a structure in which a number of conductive units 11 are placed on a sheet-shaped base material 12 side by side in a lattice pattern in the same manner as the first embodiment, with a common conductive film 18 being formed on the entire upper surface of the sheet-shaped base material 12, so that all the connection portions 16 are electrically connected, while leg portions 19 are allowed to protrude from the lower surface of the sheet-shaped base material 12 in a lattice pattern. Here, those parts that are the same as those of the first embodiment are indicated by the same reference numerals, and the description thereof is omitted.

In accordance with the present embodiment, by pressing a desired position of the protective sheet 36, the support member 14 is deflected so that a plurality of contact portions 17, located right below the pressed position, are allowed to come into contact with the fixed electrodes 36, and the fixed electrodes 34 are also made conductive through the conductive film 18 formed on the upper surface of the sheet-shaped base material 12; thus, the pressed position can be specified. Here, the contact portions 16 in the present embodiment may be installed on demand, and are not necessarily required to have a protruding shape.

Figure 10:
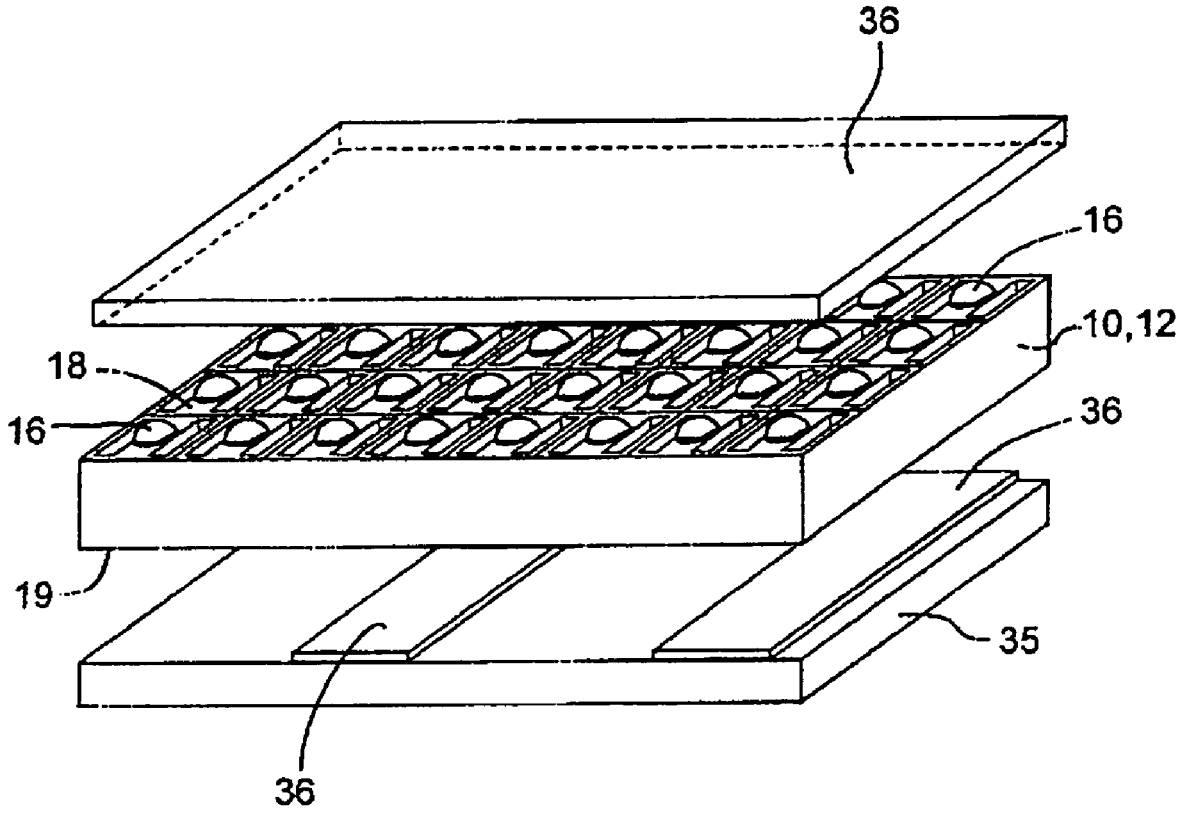
FIG. 10 is an exploded perspective view that shows a sixth embodiment in accordance with the present invention.

In a sixth embodiment, as shown in FIG. 10, the pitch between the fixed electrodes 36 attached to the lower electrode plate 35 is made wider than the pitch of the conductive units 11. In this case also, all the contact portions 16 are made conductive through the common conductive film 18 formed on the upper surface of the sheet-shaped base material 12 so that the pressed position can be specified. Since the other structure is the same as that of the fifth embodiment, the same parts are indicated by the same reference numerals, and the description thereof is omitted. Here, the leg portions 19 of the above-mentioned embodiment are not necessarily required to have a protruding shape in a lattice pattern, and may be prepared as discontinuous protruding portions.

Figure 11:
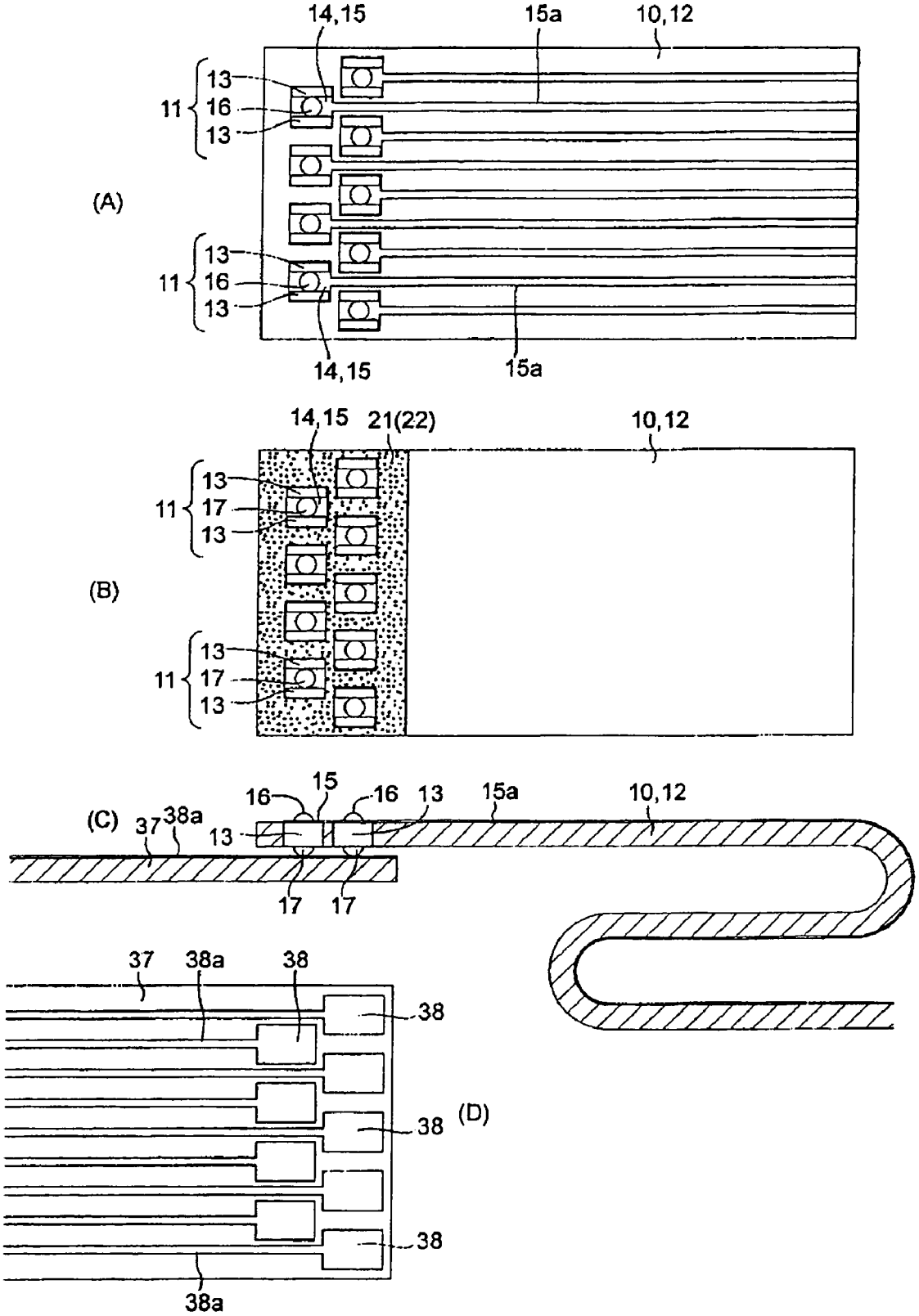
FIGS. 11A, 11B, 11C and 11D are a partial plan view, a partial bottom view and a cross sectional view showing a connection state of an anisotropic conductive film, as well as a print substrate to be integrally connected thereto, in accordance with a seventh embodiment.

In a seventh embodiment, as shown in FIG. 11, an anisotropic conductive film 10 in which a plurality of the conductive units 11 are placed side by side at least on one end, with a lead wire 15*a* that is made conductive to the contact portions 16 being printed thereon, is prepared. Moreover, an adhesive 22 and/or a bonding agent 21 are applied between the conductive units 11 on the rear surface side so as to connect in a separable manner or to permanently connect as an integral part. With this structure, with respect to the flexible print substrate 37 with lead wires 38*a* being extended from the connection pads 38, the conductive units 11 of the anisotropic conductive film 10 of the present embodiment are superposed on the connection pads 38 and integrally connected thereto so that these are electrically connected to each other.

Figure 12:
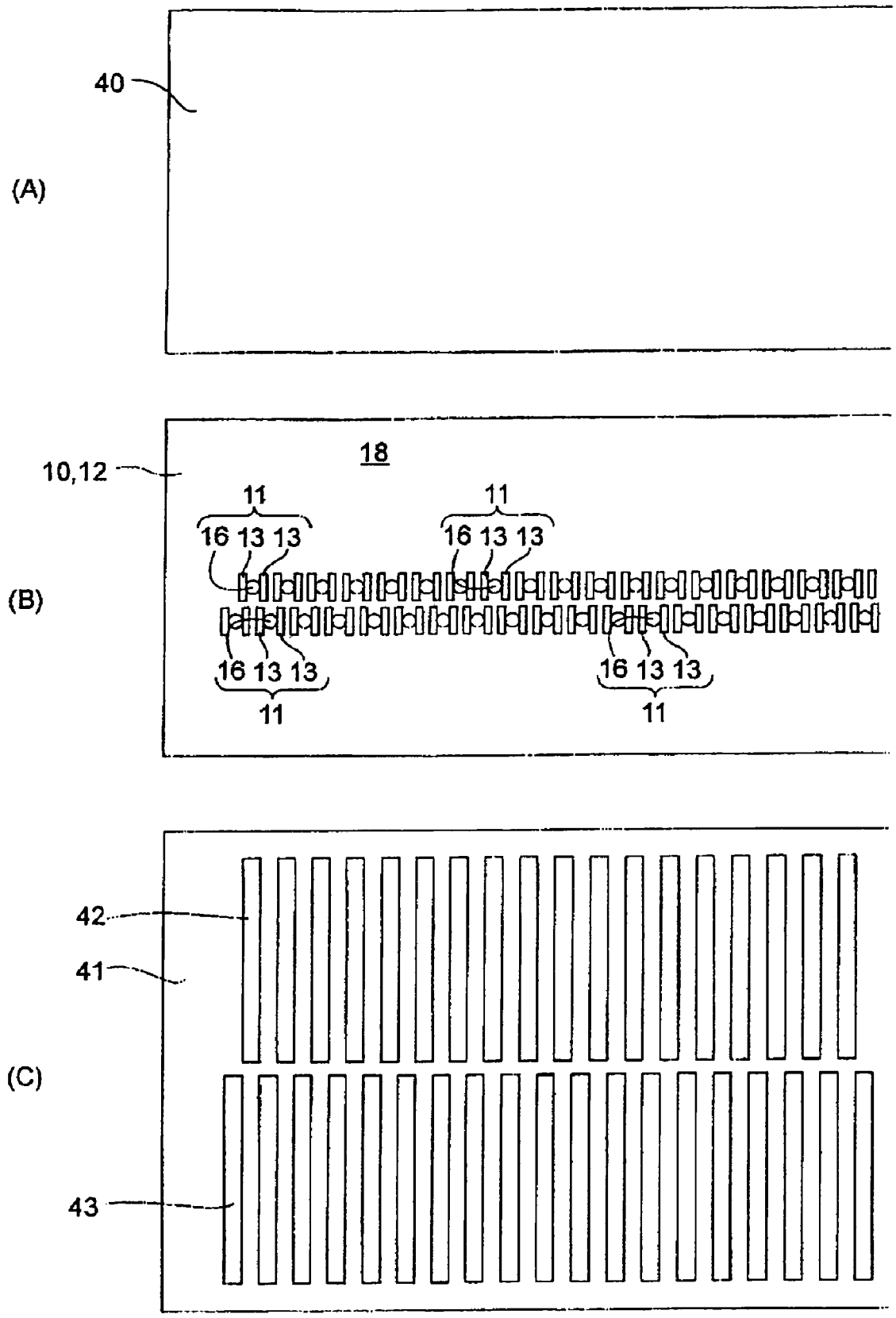
FIGS. 12A, 12B and 12C are partial plan views that show constituent parts of a linear encoder in accordance with an eighth embodiment of the present invention.

In an eighth embodiment, as shown in FIG. 12, the present invention is applied to a linear encoder, which is constituted by a protective film 40, an anisotropic conductive film 10 serving as an intermediate electrode and a lower electrode 41 to which fixed electrodes 42 and 43 are attached. The anisotropic conductive film 10 has a structure in which conductive units 11, placed in two rows, are arranged in a staggered pattern. Moreover, in the same manner as the abovementioned sixth embodiment, a conductive film 18 is formed on the entire upper surface of the anisotropic conductive film 10, with all the contract portions 16 being electrically connected. With respect to the lower electrode 41, two rows of the fixed electrodes 42 and 43, aligned side by side in parallel with each other, with equal intervals, are arranged on the upper surface thereof, in a staggered pattern. With this structure, when an external force is imposed on predetermined ones of the conductive units 11 through the protective film 40, each of the contact portions 16 of the conductive units 11, located right below the pressed position, is allowed to come into contact with one end of each of the fixed electrodes 42 and 43. Consequently, the resulting conduction through the conductive film 18 makes it possible to detect a variation in the external force. Since the other structure is the same as that of the aforementioned embodiment, the same parts are indicated by the same reference numerals, and the description thereof is omitted.

In accordance with the present embodiment, since the conductive units 11 are arranged in a staggered pattern, with the opposing conductive units 11 being mutually offset by a half pitch, the conductive units 11 are more easily made in contact with the fixed electrodes 42 and 43, thereby providing a two-fold increase in precision.

Figure 13:
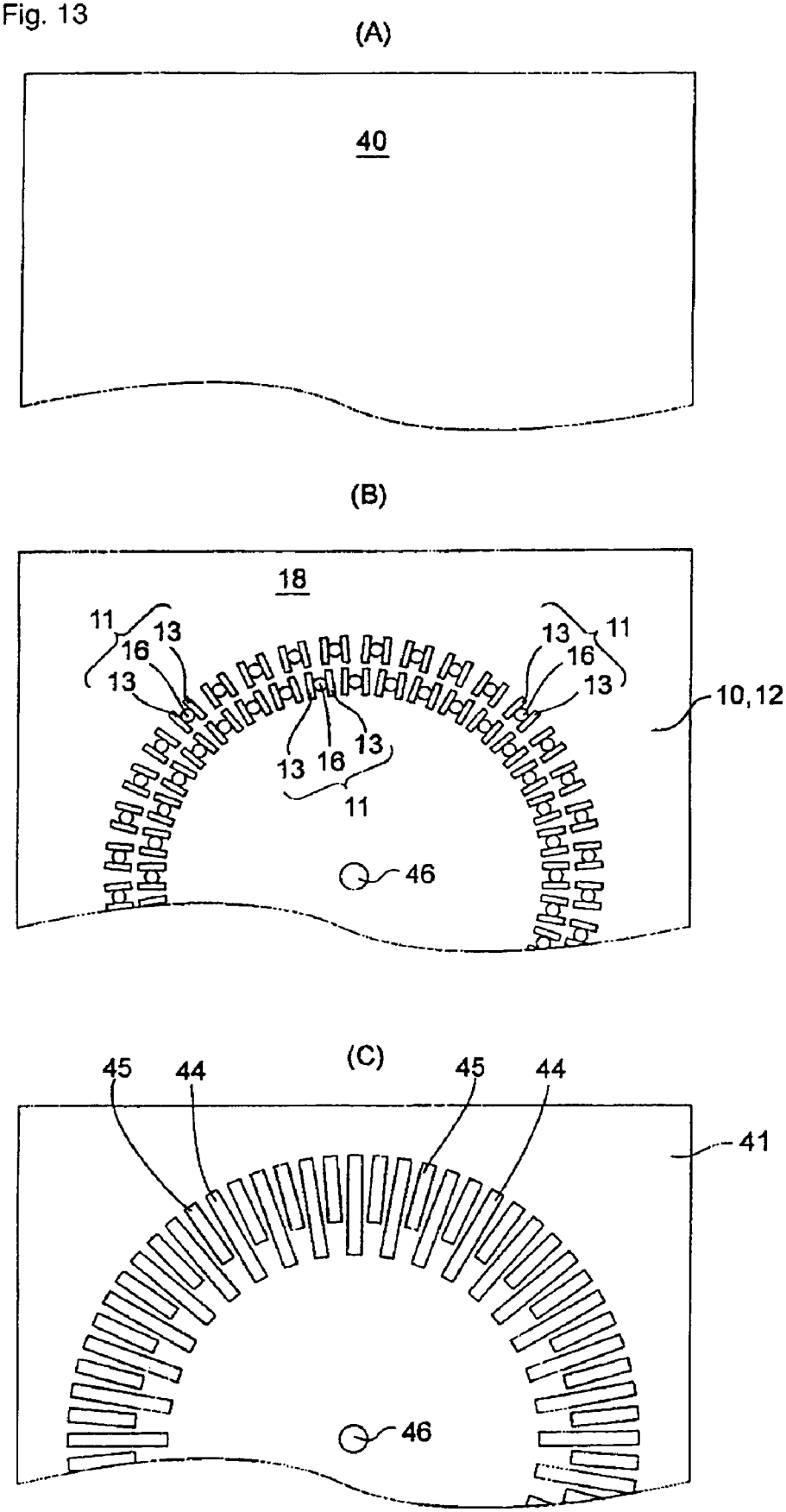
FIGS. 13A, 13B and 13C are partial plan views that show constituent parts of an annular encoder in accordance with a ninth embodiment of the present invention.

In a ninth embodiment, as shown in FIG. 13, the present invention is applied to an annular encoder, which is constituted by a protective film 40, an anisotropic conductive film 10 serving as an intermediate electrode and a lower electrode 41 in which long and short fixed electrodes 44 and 45 are placed radially. Here, an external force, which moves centered on a center hole 46 formed in the lower electrode 41 is imposed on the conductive units 11 through the protective film 40, each of the contact portions 16 of the conductive units 11 is allowed to come into contact with the long and short fixed electrodes 44 and 45 so that the resulting conduction through the conductive film 18 makes it possible to detect a variation in the external force. Since the other structure is the same as that of the eighth embodiment, the description thereof is omitted.

Here, the contact portions 16 may be formed on the surface of the conductive film as contacts prepared as separate members, or may be prepared as protruding portions that are formed on the upper and rear surfaces of the support member 14, and coated with a conductive film.

In the present embodiments, explanations have been given by exemplifying a structure in which the integrally connecting process is carried out by using an adhesive or a bonding agent; however, not limited to this structure, the anisotropic conductive film may be integrally connected to an external connection pad or the like through a mechanical mechanism.

Moreover, the contact portions of the anisotropic conductive film of the present invention are not necessarily required to have a protruding shape as described in the foregoing embodiments, and may be made flush with the support member, as long as the connection pads or the like connected to the external circuit have a protruding shape.

INDUSTRIAL APPLICABILITY

Not limited to the aforementioned connector, switch, pressure-sensitive sensor and encoder, the anisotropic conductive film in accordance with the present invention can be applied to the other connectors or the like.

The invention claimed is:

1. An anisotropic conductive film comprising:

a support member, on which at least one slit is formed, the support member being arranged in a cut out of a sheet-shaped base material made of a flexible insulating film, the support member being arranged with contact portions respectively placed on the upper and lower surfaces thereof; and a conductive film that makes only a pair of the contact portions, placed on the upper and lower surfaces, mutually conductive to each other independently, so that a conductive unit is formed, wherein a number of the conductive units are placed side by side, wherein the support member is elastically deformable or at least in part deflectable by compression, and wherein upon deflection or deformation the support member does not fill the cut out of the slit.

2. The anisotropic conductive film according to claim 1, wherein the support member has a two-end supported beam shape.

3. The anisotropic conductive film according to claim 1, wherein the support member has a cantilever beam shape.

4. The anisotropic conductive film according to claim 1, wherein the support member is supported at two ends, with a twisting action being exerted thereon.

5. The anisotropic conductive film according to claim 1, wherein the contact portions are prepared as metal contacts formed on the surface of the conductive film.

6. The anisotropic conductive film according to claim 1, wherein the contact portions are prepared by forming a conductive film on the surface of protruding portions that protrude from each of the surface and rear surface of the support member.

7. The anisotropic conductive film according to claim 1, wherein a lead wire that is conductive to each of the contact portions is formed on one of the surfaces of the sheet-shaped base material.

8. The anisotropic conductive film according to claim 1, wherein: a common conductive film, which makes all the contact portions located on the surface of the sheet-shaped base material conductive is formed on the surface, and a leg portion, which is higher than the contact portions placed on the rear face of the sheet-shaped base material, is formed on the rear surface in a protruding manner.

9. The anisotropic conductive film according to claim 8, wherein the contact portions are linearly placed.

10. The anisotropic conductive film according to claim 8, wherein the contact portions are placed in an annular pattern.

11. The anisotropic conductive film according to claim 1, wherein a bonding agent is sealed in the slit, with a microcapsule, which is ruptured upon application of pressure, being also injected therein.

12. The anisotropic conductive film according to claim 1, wherein a bonding agent is sealed in the peripheral edge portion of the slit, with a microcapsule, which is ruptured upon application of pressure, being placed therein.

13. The anisotropic conductive film according to claim 1, wherein an adhesive, which is allowed to exert a bonding function when heated, is placed in the peripheral edge portion of the slit

14. The anisotropic conductive film according to claim 2, wherein the contact portions are prepared as metal contacts formed on the surface of the conductive film.

15. The anisotropic conductive film according to claim 3, wherein the contact portions are prepared as metal contacts formed on the surface of the conductive film.

16. The anisotropic conductive film according to claim 4, wherein the contact portions are prepared as metal contacts formed on the surface of the conductive film.

17. The anisotropic conductive film according to claim 2, wherein the contact portions are prepared by forming a conductive film on the surface of protruding portions that protrude from each of the surface and rear surface of the support member.

18. The anisotropic conductive film according to claim 3, wherein the contact portions are prepared by forming a conductive film on the surface of protruding portions that protrude from each of the surface and rear surface of the support member.

19. The anisotropic conductive film according to claim 4, wherein the contact portions are prepared by forming a conductive film on the surface of protruding portions that protrude from each of the surface and rear surface of the support member.

20. The anisotropic conductive film according to claim 5, wherein the contact portions are prepared by forming a conductive film on the surface of protruding portions that protrude from each of the surface and rear surface of the support member.

* * * * *